US011117179B2

(12) United States Patent
Walz et al.

(10) Patent No.: US 11,117,179 B2
(45) Date of Patent: Sep. 14, 2021

(54) PUNCHING TOOLS

(71) Applicant: TRUMPF Werkzeugmaschinen GmbH + Co. KG, Ditzingen (DE)

(72) Inventors: Martin Walz, Stuttgart (DE); Yakup Coskun, Gerlingen (DE); Markus Hees, Vaihingen an der Enz (DE); Thomas Burzig, Ditzingen (DE); Martin Steiner, Weil der Stadt (DE)

(73) Assignee: TRUMPF Werkzeugmaschinen GmbH + Co. KG, Ditzingen (DE)

( * ) Notice: Subject to any disclaimer, the term of this patent is extended or adjusted under 35 U.S.C. 154(b) by 0 days.

(21) Appl. No.: 15/192,081

(22) Filed: Jun. 24, 2016

(65) Prior Publication Data

US 2017/0001233 A1 Jan. 5, 2017

(30) Foreign Application Priority Data

Jun. 30, 2015 (EP) ..... 15174529

(51) Int. Cl.
*B21D 28/26* (2006.01)
*B21D 28/06* (2006.01)
*B26F 1/14* (2006.01)

(52) U.S. Cl.
CPC ..... *B21D 28/26* (2013.01); *B21D 28/06* (2013.01); *B26F 1/14* (2013.01)

(58) Field of Classification Search
CPC ..... B21D 28/06; B21D 28/08; B21D 28/00; B21D 28/02; B21D 28/24; B26F 1/14
See application file for complete search history.

(56) References Cited

U.S. PATENT DOCUMENTS 264,629 A * 9/1882 Constantine ..... B26F 1/14 83/689
425,456 A * 4/1890 Piper ..... B26F 1/14 83/689

(Continued)

FOREIGN PATENT DOCUMENTS

CN 2223150 3/1996
CN 201088989 7/2008

(Continued)

OTHER PUBLICATIONS

Office Action in Chinese Application No. 201610563033.6, dated Jul. 15, 2019, 18 pages (with English translation).

(Continued)

*Primary Examiner* — Ghassem Alie
*Assistant Examiner* — Fernando A Ayala
(74) *Attorney, Agent, or Firm* — Fish & Richardson P.C.

(57) ABSTRACT

The disclosure relates to punching tools for punching machines for punching plate-shaped materials. The punching tools have an upper tool part with an upper cutting edge and a lower tool part with a lower cutting edge that move axially with respect to each other. The upper and lower cutting edges are arranged to cut off a part of the workpiece in a punching stoke. The upper cutting edge and/or the lower cutting edge include one or more transition regions that separate the cutting edge into at least two adjacent portions. The transition regions include, in the punching direction with respect to the respective adjacent portions, a discontinuity that is adapted to cut the material cut off from the workpiece into two or more individual parts in the same punching stroke.

9 Claims, 7 Drawing Sheets

(56) References Cited

U.S. PATENT DOCUMENTS 1,675,910 A * 7/1928 Riker ..... B21D 19/08 72/325
1,837,451 A * 12/1931 Lee ..... B21D 49/00 72/325
2,555,069 A * 5/1951 Verney ..... B23D 21/02 83/613
3,368,269 A * 2/1968 Perlman ..... A44B 19/58 29/33.2
3,504,588 A * 4/1970 Thomas ..... B26F 1/14 83/685
3,728,892 A * 4/1973 Sangster ..... B21J 13/00 470/205
4,307,499 A * 12/1981 Isella ..... A44B 19/58 29/33.2
4,457,200 A * 7/1984 Borzym ..... B23D 21/00 83/319
4,739,687 A * 4/1988 Wanner ..... B21D 28/34 83/688
4,905,557 A * 3/1990 Adleman ..... B21D 28/343 30/360
6,009,612 A * 1/2000 Fiedrich ..... F24D 3/16 29/432.2
8,978,431 B1 * 3/2015 Kernosky ..... B26F 1/14 29/896.6
9,381,559 B2 * 7/2016 Matsumura ..... B21D 28/02
2003/0183057 A1 * 10/2003 Birch ..... B26F 1/14 83/55
2006/0107721 A1 * 5/2006 Oishi ..... B21D 28/26 72/327
2010/0212388 A1 * 8/2010 Oishi ..... B21D 28/26 72/327

FOREIGN PATENT DOCUMENTS

| | | | |
|---|---|---|---|
| CN | 203030710 | | 7/2013 |
| CN | 103286192 | | 9/2013 |
| CN | 203649115 | | 6/2014 |
| CN | 102806265 | B | 11/2014 |
| CN | 204208973 | | 3/2015 |
| EP | 2662160 | A1 | 11/2013 |
| JP | 6297053 | A | 10/1994 |
| JP | 7275964 | A | 10/1995 |
| JP | 2003230920 | A1 | 8/2003 |
| WO | WO11158582 | A1 | 12/2011 |
| WO | WO2014065106 | A1 | 5/2014 |

OTHER PUBLICATIONS

Office Action in Chinese Application No. 201610563033.6, dated Dec. 3, 2018, 12 pages (with English summary).

* cited by examiner

PUNCHING TOOLS

CROSS-REFERENCE TO RELATED APPLICATION

This application claims priority under 35 U.S.C. § 119(a) to European Application No. 15 174 529.6, filed on Jun. 30, 2015, the entire contents of which are hereby incorporated by reference.

TECHNICAL FIELD

The invention relates to punching tools, in particular, to punching tools used in a universal punching machine in which scissels, also called punching slugs, are disposed of through an opening or orifice in a lower tool part.

BACKGROUND

To enhance the efficiency of the punching process, the cutting edges at the punching tools have been elongated so that a larger length of the workpiece can be machined by a single punching stroke. However, due to the elongation of the cutting edges in punching tools for universal punching machines, the material cut off from the plate-shaped workpiece is elongated.

Inasmuch as the size of the cut off material allows for, it is usually discharged through an orifice in a lower tool part. However, the size of this orifice is limited by the size of the lower tool holder in conjunction with the structure of the lower tool part so that it cannot be arbitrarily increased. Therefore, disposal of the cut off material becomes more difficult when it becomes longer. When its length is larger than the diameter of the orifice, amongst other problems, there is the risk that the cut off material jams or seizes in the orifice.

SUMMARY

The invention is based, at least in part, on the object to provide a punching tool and a method eliminating the above disadvantages and enabling an efficient, reliable punching processing. According to one aspect of the invention, at least one cutting edge of the punching tool comprises a discontinuity being adapted such that the cut off material is divided in two or more individual parts in the same punching stroke in which material is cut off from the workpiece so that a linear dimension of the respective divided parts of the cut off material is shorter. Thereby, the length of the cutting edge can be enlarged and the efficiency of the punching process can thus be increased without the problems of possible jamming or seizing during disposal of the cut off parts of material.

In a first aspect, the disclosure provides punching tools for punching machines for punching a plate-shaped workpiece. The punching tools include an upper tool part and a lower tool part that when mounted in a punching machine are arranged to move relative to each other in a punching direction, wherein: the upper tool part comprises an upper cutting edge and the lower tool part comprises a lower cutting edge having a shape complementary to the upper cutting edge and being arranged opposite thereto so that a material is cut off from the workpiece by the cutting edges upon a punching stoke; the upper cutting edge and the lower cutting edge are arranged at a varying distance (A) apart from each other in the punching direction when the punching tool is mounted in the punching machine in a predetermined positon of the upper tool part and the lower tool part; and wherein the upper cutting edge and/or the lower cutting edge are/is partitioned into at least two portions by at least one transition region, wherein the transition region comprises relative to the respectively adjacent portions of the cutting edge in the punching direction between adjacent portions a discontinuity being adapted such that the material cut off from the workpiece is separated into two or more individual parts in one punching stroke.

In some embodiments, the distance (A) at the transition region is smaller than in at least one of the adjacent portions or the distance (A) between the upper cutting edge and the lower cutting edge is constant within at least one of the portions. In certain implementations, the distance (A) in respectively adjacent portions increases stepwise in a direction along the cutting edges or can increase and/or decrease stepwise in a direction along the cutting edges. In other implementations, the respective distance (A) of adjacent portions increases and decreases alternatingly stepwise along the cutting edges. In different embodiments, the distance (A) within one portion is or is not identical to a distance (A) of the next-but-one portion. In some implementations, the distance (A) within one of the portions is not constant.

In some implementations, the transition region includes or is a step or includes a transition point in the form of a tip. In some embodiments having such a tip, the distance (A) in the portions adjacent to the tip is not constant. In some embodiments, the distance (A) in the respectively adjacent portion linearly increases along the cutting edge. Alternatively, in some implementations the distance (A) in the portion increases non-linearly along the cutting edge so that a linear dimension of the material cut off from the workpiece is reduced by deforming in the punching direction by the cutting edge.

In certain embodiments, the cutting edge includes a convex shape in the punching direction in the portion. In the same or other embodiments, the cutting edge includes a concave shape in the punching direction in the portion.

In some embodiments, the upper tool part can include an upper cutting face and the lower tool part can include a lower cutting face, wherein the upper cutting edge delimits the upper cutting face and the lower cutting edge delimits the lower cutting face, wherein the upper tool part includes a second upper cutting edge having a continuous course without discontinuities and, in the punching direction, is set back opposite to the punching direction with respect to the upper cutting edge and is arranged laterally outside of the upper and lower cutting face and adjacent the upper and lower cutting edge to perform a second cut in cooperation with the lower cutting edge during the same punching stroke of the punching machine.

In another aspect, the present disclosure provides methods for cutting off material from a workpiece and for reducing a linear dimension of the material cut off from the workpiece. The methods include obtaining a punching tool as described herein and mounting the punching tool into a punching machine; inserting a workpiece into the punching machine; and performing a single punching stroke with the punching tool, whereby a part of the material to be cut off from the workpiece is cut off by a discontinuous cutting edge and a linear dimension of the cut off part is reduced by cutting the cut off part of the material by a discontinuity at a transition region in the same punching stroke.

In these methods, the punching tool can include a transition region that further reduces the linear dimension of the cut off part of the material by deforming the cut off part of the material. In some embodiments, a further part of the material to be cut off is cut off subsequently by a second cutting edge on the punching tool in the same punching stroke.

The invention is further elucidated by means of embodiments referring to the attached drawings.

DETAILED DESCRIPTION

Figure 1A:
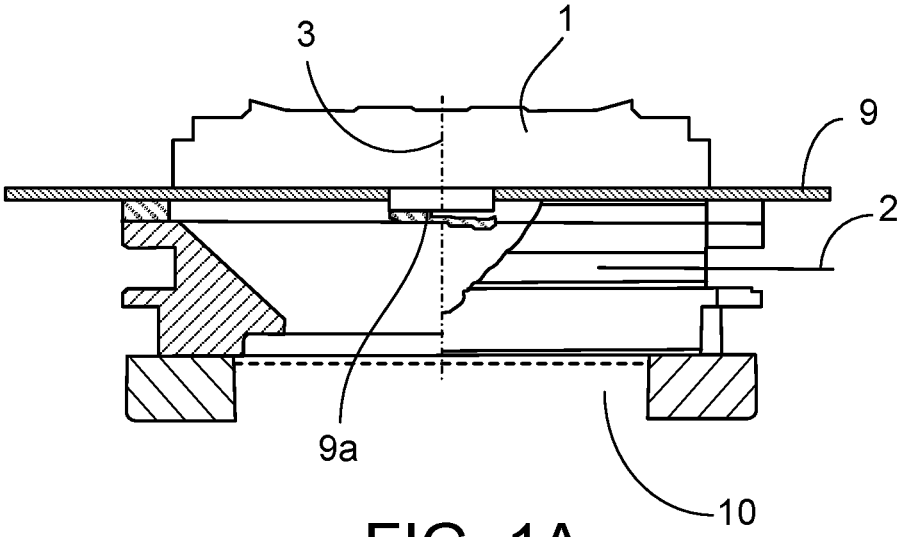
FIG. 1A shows a partial sectional side view of an upper tool part and a lower tool part during a punching stroke in which a portion of the cutting edges cuts off a portion of a material to be cut off.

FIG. 1A shows a partial sectional side view of an upper tool part 1 and of a lower tool part 2 of a punching tool. The upper tool part 1 and the lower tool part 2 are shown in a state being mounted in a punching machine and they have an axis 3. The upper tool part 1 and the lower tool part 2 are movable relatively with respect to each other along the axis 3.

The lower tool part 2 is accommodated in a tool holder (not shown) and the punching machine comprises a drop out orifice 10 through which cut off material can exit.

Figure 1B:
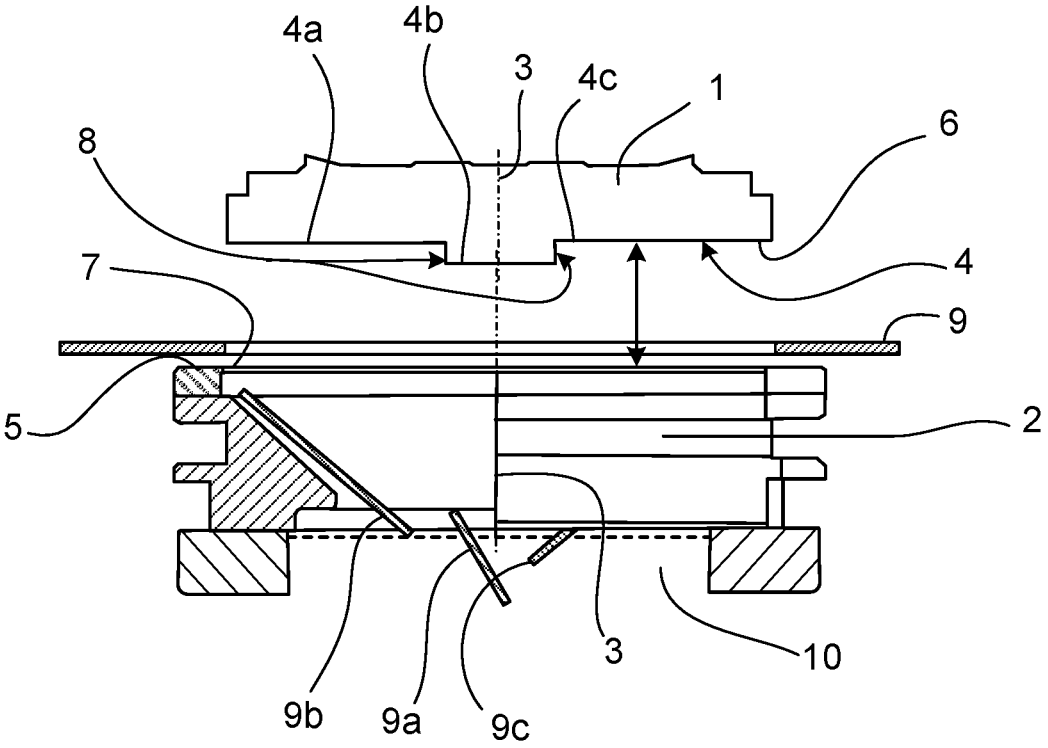
FIG. 1B shows a partial sectional side view of the upper tool part and the lower tool part of FIG. 1A with the divided cut off material after a completed punching stroke.

FIG. 1B shows the upper tool part 1 and the lower tool part 2 of FIG. 1A after a completed punching stroke. Due to the state when the upper tool part 1 and the lower tool part 2 moved apart from each other, an upper cutting edge 6 of the upper tool part 1 and a lower cutting edge 7 of the lower tool part 2 can be seen in this illustration.

The upper cutting edge 6 delimits an upper cutting face 4 and the lower cutting edge 7 delimits a lower cutting face 5. The cutting edges 6, 7 are complementary with respect to each other and they have a required clearance.

The cutting faces 4, 5 are provided respectively at front sides of the upper tool part 1 and the lower tool part 2 in direction of the axis 3, i.e., in the punching direction. The upper cutting face 4 of the upper tool part 1 and the upper cutting edge 6 are partitioned in three portions 4*a*, 4*b*, and 4*c* along the cutting edge 6. As shown below, the upper cutting edge 6 can alternatively also be partitioned in another number of portions. However, at least two portions must be provided. Between the portions 4*a*, 4*b*, and 4*c*, a transition region 8 is respectively provided. The transition region 8 comprises a discontinuity along the upper cutting edge 6 in direction of the axis 3. As used herein, the term "discontinuity," means a sudden change of the upper cutting face. Examples of a discontinuity include, e.g., a step, a kink, or a tip.

Alternatively, also the lower cutting face 5 of the lower tool part 2 may comprise a transition region 8. Hereby, it is then necessary that the lower tool part 2 is provided with a spring-loaded stripper or that the punching machine is provided with an active lower tool holder enabling an axial motion of the lower tool part 2.

As shown in FIG. 1B, the transition regions 8 respectively separate portions 4*a* and 4*b*, and portions 4*b* and 4*c*. At the portions 4*a*, 4*b*, and 4*c*, the upper cutting edge 6 and the lower cutting edge 7 have a distance A in direction of the axis 3 from each other in a respectively predetermined position of the upper tool part 1 and the lower tool part 2. In the embodiment shown in FIGS. 1A and 1B, the distance A within one of the portions 4*a*, 4*b*, and 4*c* is constant and it increases or decreases stepwise along the cutting edges 6, 7.

In operation, a punching stroke of the upper tool part 1 is performed after a positioning of a plate-shaped workpiece 9, e.g., a piece of sheet metal. Thereby, during the punching stroke, firstly, an inner area of a contour to be punched out is stretched against its internal stress beyond its elastic limit or yield strength until the material cracks by the portion 4*b* with the least axial distance A between the upper cutting edge 6 and the lower cutting edge 7 and a segment 9*a* of a material to be cut off drops downwardly through the drop out orifice 10 (as shown in FIG. 1B).

When further moving the upper tool part 1 during the punching stroke, further segments 9*b*, 9*c* of the residual material to be cut off are cut off by means of the same mechanism and drop downwardly through the drop out orifice 10 (FIG. 1B).

By cutting the cut off material of the workpiece 9 into three parts, the cut off material, the entire linear dimension of which would otherwise be larger than a diameter of the drop out orifice 10, can reliably be disposed of through the drop out orifice 10 without seizing or jamming.

The separation of the punching slugs during a single punching stroke along several planes, e.g., into several pieces, results basically from the velocity of the punching stroke and the resistivity of the material or raw material to be punched. In the case in which the resistivity of the material or raw material to be punched is relatively low, an emerging punching slug is partially deformed or bent before it is divided, whereby a enveloping circle (i.e., a projected length of the punching slug when the bent punching slug is projected onto a underlying plane) of the punching slug to be disposed of is smaller than the drop out orifice 10 of the punching machine. However, it is not necessary that the transition region 8 has an exact discontinuity, but slight deviations of an ideal step, an ideal tip, or an ideal kink are possible as long as the resistivity of the material or raw material to be punched in conjunction with the velocity of the punching stroke enables cutting.

Figure 2:
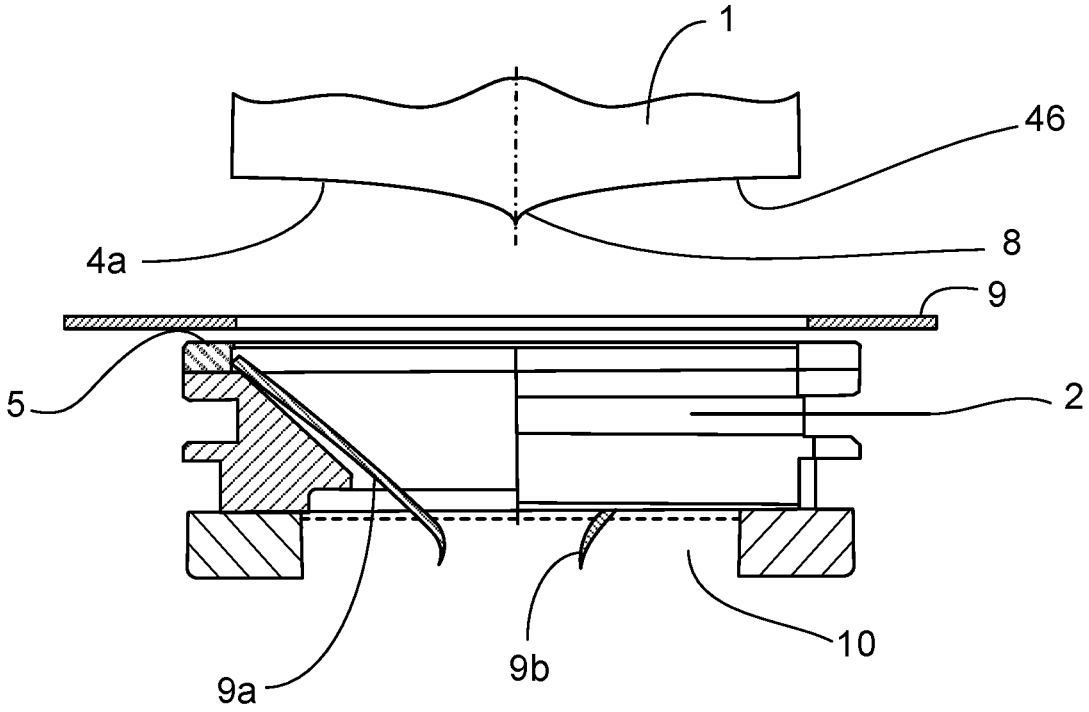
FIG. 2 shows a partial sectional side view of an upper tool part and a lower tool part with divided and deformed cut off material after a completed punching stroke.

In FIG. 2, a partial sectional side view of the upper tool part 1 of another embodiment and of the lower tool part 2 after a completed punching stroke is shown. In this embodiment, the upper tool part 1 comprises a transition region 8 in the form of a transition point configured as a tip. The lower tool part 2 is unchanged with respect to the preceding embodiment.

In operation, in this embodiment a segment is not previously punched out such as in FIGS. 1A and 1B. Here, during the punching stroke, the material is firstly stretched beyond its elasticity limit or its yield strength by the tip until it is deformed or divided and, then, the material to be cut off is cut off from the workpiece 9 by the cutting edges 6 at the portions 4*a*, 4*b* in a further motion of the upper tool part 1 in the same punching stroke, whereby it is divided into the two segments 9*a*, 9*b*. Also here, the cut off material, the entire linear dimension of which is larger than a diameter of the drop out orifice 10, is reliably disposed of through the drop out orifice 10 without seizing or jamming by cutting the cut off material into the two segments 9*a* and 9*b*.

The cutting edges 6 of the portions 4*a*, 4*b* adjacent to the transition point 8 configured as a tip have a distance A in the punching direction to the second cutting edge 7, which is not constant within the portions 4*a*, 4*b*. The distance A increases in a non-linear manner and the cutting edges 6 in the portions 4*a*, 4*b* have a concave shape in this embodiment. By the non-linear change (concave shape), the segments 9*a*, 9*b* are additionally deformed so that a linear dimension, therefore, a projected length, of the cut off material is further shortened. Thereby, it is possible to avoid the need for additional transition points 8. In addition, further enlargement of the cutting edges 4, 5 is possible without increasing the risk of seizing or jamming in an orifice of the lower tool part 2 or in the drop out orifice 10.

FIGS. 3 to 6 show various embodiments of transition regions 8 and arrangements of portions 4*a*, 4*b*, 4*c*, 4*d*, and 4*e*. The lower cutting edge 7 of the lower tool part 2 is not illustrated here, but in conjunction with these figures, the term "axial distance A" as discussed above means the axial distance from the upper cutting edge 6 to the lower cutting edge 7.

Figure 3A:
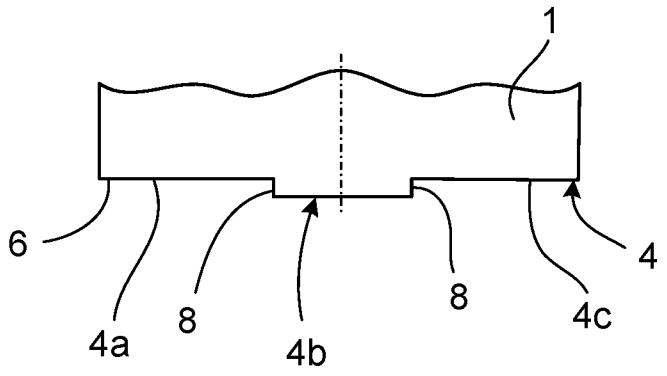
FIGS. 3A, 3B, and 3C show schematic side views of an upper tool part having step-shaped transitions and having portions of the cutting edges with a respectively constant distance in a punching direction to a cutting edge of a lower tool part (not shown).
Figure 3B:
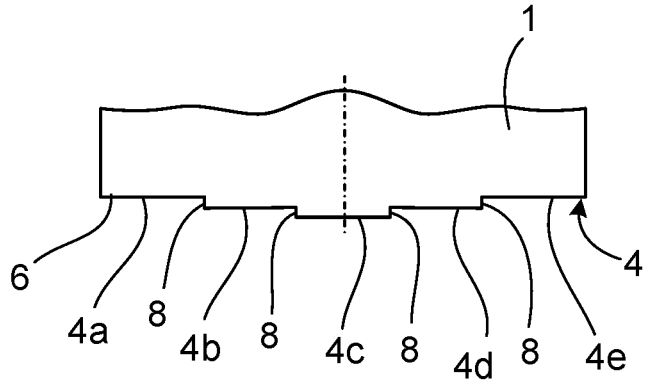
Figure 3C:
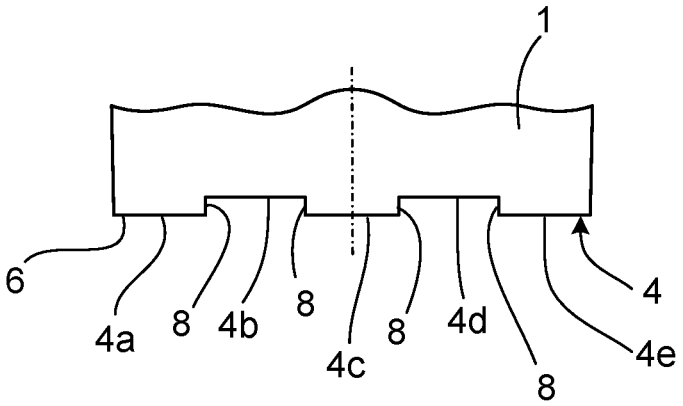

FIGS. 3A to 3C, respectively, show an upper tool part 1, the upper cutting face 4 and the upper cutting edge 6, both of which are partitioned by steps (bounds) as transition points 8 into three portions 4*a*, 4*b*, and 4*c* (as shown in FIG. 3A) or the five portions 4*a*, 4*b*, 4*c*, 4*d*, and 4*e* (as shown in FIGS. 3B and 3C).

In FIGS. 3A and 3B, the distance A in the punching direction of the upper cutting edge 6 in the portions 4*a*, 4*b*, 4*c*, 4*d*, and 4*e* increases respectively stepwise in a direction from the center along the upper cutting edge 6. Alternatively, the distances can also increase stepwise beginning from an end of the cutting edge 6.

In FIG. 3C, at the portions 4*a*, 4*b*, 4*c*, 4*d*, and 4*e*, the distance in the punching direction of the upper cutting edge 6 of the upper tool part 1 increases or decreases stepwise along the cutting edge 6. The distance A of the cutting edge 6 of one of the portions 4*a*, 4*b*, 4*c*, 4*d*, and 4*e* in this embodiment is identical to the distance A of the cutting edge 6 of the next-but-one portion 4*a*, 4*b*, 4*c*, 4*d*, and 4*e*. In an alternative embodiment, the distance A of the cutting edge of the next-but-one portion 4*a*, 4*b*, 4*c*, 4*d*, and 4*e* is not identical.

Figure 4A:
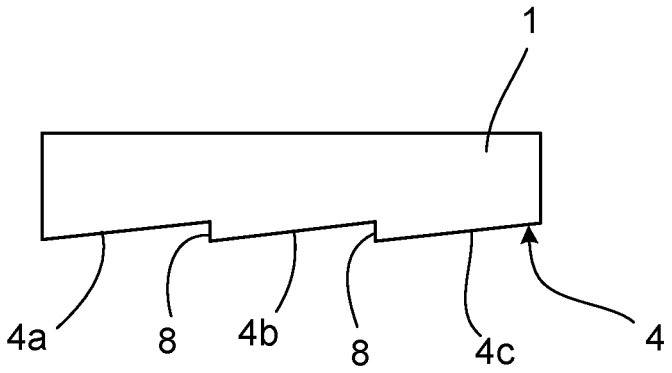
FIGS. 4A and 4B show schematic side views of an upper tool part having step-shaped transitions and having portions with a respectively non-constant distance in the punching direction to the cutting edge of a lower tool part (not shown).
Figure 4B:
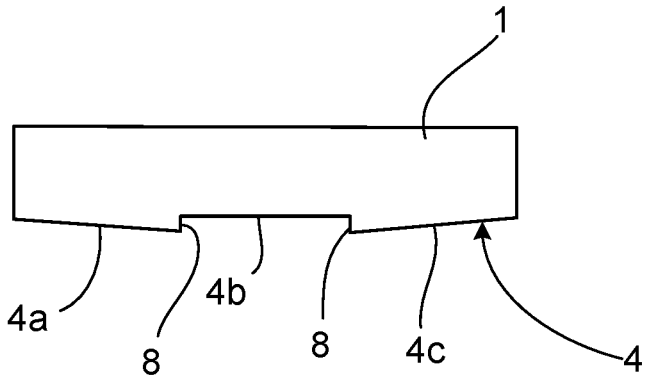

In FIGS. 4A and 4B, the upper cutting face 4 and the upper cutting edge 6 of the upper tool part 1 comprise the portions 4*a*, 4*b*, 4*c*, (FIG. 4A) or the portions 4*a*, 4*c* (FIG. 4B) where the distance A from the upper cutting edge 6 to the lower cutting edge 7 is not constant. Here, a saw tooth shape along the cutting edges is formed by the shape of the portions.

Figure 5A:
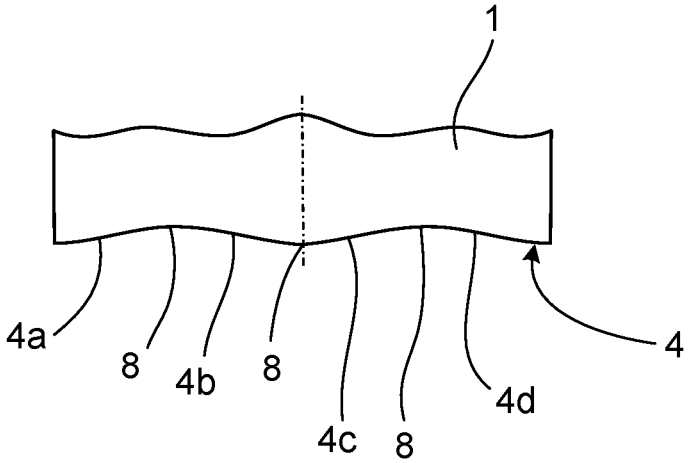
FIGS. 5A and 5B show schematic side views of an upper tool part having kinks as transitions and having portions with a respectively non-constant distance in the punching direction to the cutting edge of a lower tool part (not shown).
Figure 5B:
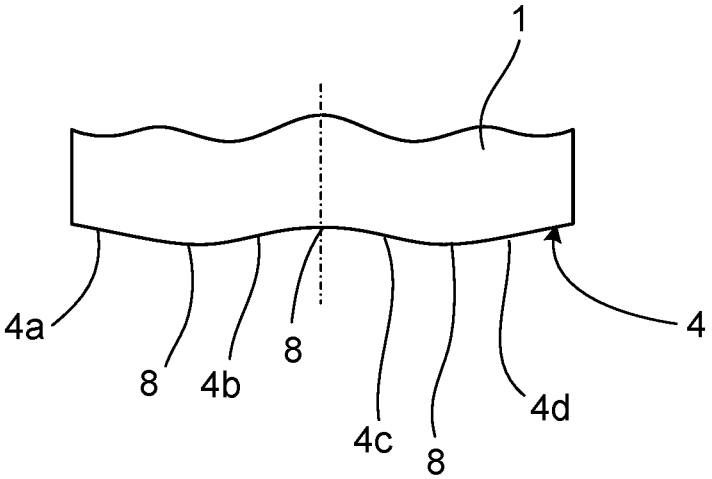

Also in FIGS. 5A and 5B, the distance A in the punching direction between the upper cutting edge 6 of the upper tool part 1 and the lower cutting edge 7 within the portions 4*a*, 4*b*, 4*c*, and 4*d* is not constant. However, in these embodiments, the transition points or regions 8 are formed as discontinuations in the form of kinks.

Figure 6A:
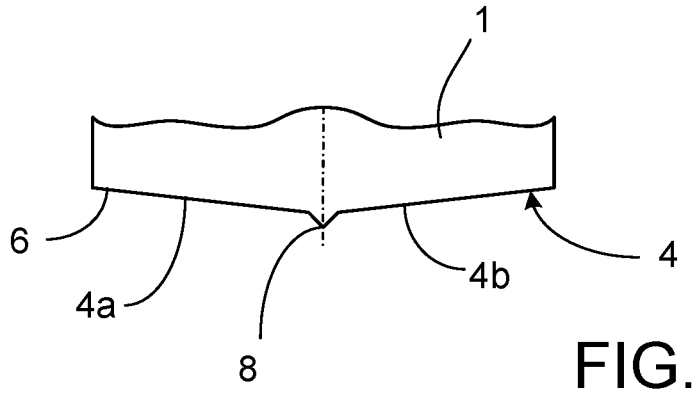
FIG. 6A shows a schematic side view of an upper tool part having a tip as transition and having portions having a respectively non-constant distance in the punching direction to the cutting edge of a lower tool part (not shown).
Figure 6B:
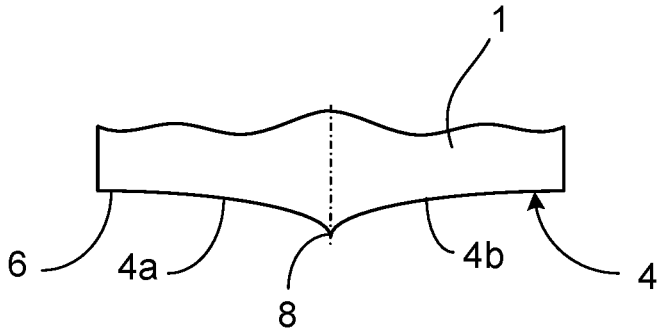
FIG. 6B shows a schematic side view of an upper tool part having a tip as transition point and having portions with concave shapes.
Figure 6C:
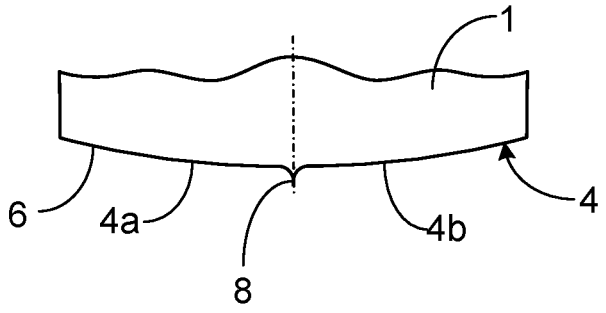
FIG. 6C shows a schematic side view of an upper tool part having a tip as transition point and having portions with convex shapes.

In FIG. 6A to 6C, as also in FIG. 2, the transition region 8 in the form of a transition point configured as a discontinuation of the cutting face 4 of the upper tool part 1 in the shape of the tip. The distance A in the punching direction between the upper cutting edge 6 and the lower cutting edge 7 is not constant within the several portions 4*a*, 4*b* adjacent to the tip.

In FIG. 6A, beginning from the tip, the distance A in the punching direction from the upper cutting edge 6 to the lower cutting edge 7 linearly increases along the upper cutting edge 6 within the portion 4*a*, 4*b*.

In FIGS. 6B and 6C, the distance A increases non-linearly and as described with respect to FIG. 2, in addition to being severed the cut off material is also deformed in the punching direction by the concave shape (FIG. 6B) or convex shape (FIG. 6C), whereby the linear dimension of the cut off part is additionally decreased.

By the transition region 8 in the form of a transition point shaped as a discontinuity, mainly by a transition point 8 configured as a step, a varying rollover can occur so that a proper edge cannot be manufactured in the punching process, because the cut edge may be uneven.

Figure 7A:
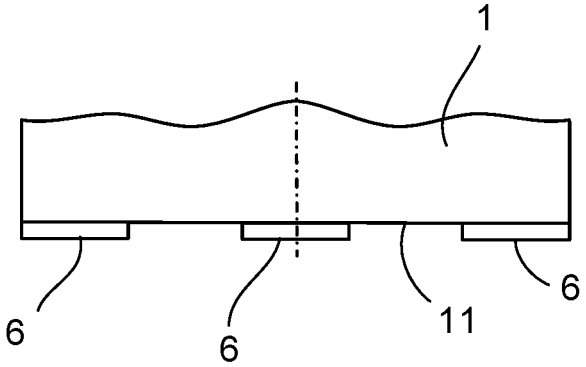
FIG. 7A shows a schematic side view of the upper tool part having portions with step-shaped transition points and with a respectively constant distance in the punching direction to the cutting edge of the lower tool part (not shown) and with additional further cutting edges.
Figure 7B:
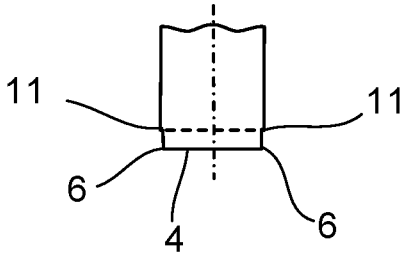
FIG. 7B shows a schematic front view of the upper tool part of FIG. 7A.

FIGS. 7A and 7B show a punching tool that in addition to the upper cutting edges 6 and a lower cutting edges 7 has, a further upper cutting edge 11 on the upper tool part 1, which corresponds to the lower cutting edge 7 on the lower tool part 2. The further upper cutting edge 11 is set back with respect to the upper cutting edge 6 in the axial direction and, as shown in FIG. 7B, is arranged laterally of the upper cutting edge 6 outside the upper cutting face 4 at the upper tool part 1. The lateral offset between the upper cutting edge 6 and the further upper cutting edge 11 amounts to a few tenths of a millimeter. Provided that the function of the cutting and/or the deforming of the cut off material and an even cut are enabled, the lateral offset can alternatively also be some other size.

In operation, a part of the material to be cut off is severed by the upper cutting edge 6 and the lower cutting edge 7 and is cut, and separated, and as the case may be, deformed, as described with respect to FIGS. 1A to 1C, in a first step in one and the same punching stroke, whereby, however, a varying rollover can occur. When continuing the same punching stroke, in a second step, a further portion of the material to be cut off, namely remaining residual of material between a pre-punching contour and a finish-punching contour, breaks by the further upper steady cutting edge 11 and the lower cutting edge 7 and a punching edge having a continuous rollover results. The material cut off from the workpiece 9 is divided into the segments 9*a*, 9*b*, and 9*c*. Since a width of the remaining residual of material is only very small, these are also divided and the segments 9*a*, 9*b*, and 9*c* with the respective residuals of material can be disposed of through the drop off orifice 10 without the risk of seizing or jamming.

The various embodiments can be combined to each other.

OTHER EMBODIMENTS

A number of embodiments of the invention have been described. Nevertheless, it will be understood that various modifications may be made without departing from the spirit and scope of the invention. Accordingly, other embodiments are within the scope of the following claims.

What is claimed is:

1. A punching tool for a punching machine for cutting off material from a plate-shaped workpiece and for reducing a linear dimension of the material cut off from the workpiece, the punching tool comprising an elongated upper tool part and an elongated lower tool part that when mounted in a punching machine are arranged to move relative to each other in a punching direction, wherein: the elongated upper tool part comprises a first upper cutting edge and the lower tool part comprises a lower cutting edge, wherein the first upper cutting edge comprises two narrow side cutting edges and two elongated side cutting edges of the elongated upper tool part to delimit an upper cutting face and the lower cutting edge comprises side edges of the elongated lower tool part to delimit a lower cutting face, wherein the first upper cutting edge and the lower cutting edge are arranged opposite to each other, respectively, so that a material is cut off from the workpiece by the respective first upper cutting edge and the lower cutting edge upon a punching stoke; the two elongated side cutting edges of the first upper cutting edge are each partitioned into two portions by a transition region comprising a discontinuity in the form of a sharp cutting tip, wherein the discontinuity of the sharp cutting tip comprises a triangular cross-section with sides having an angle that is steeper than an angle of the two portions of the elongated side cutting edges on either side of the discontinuity when viewed perpendicular to the elongated side cutting edges, and wherein a second upper cutting edge extends across the entire upper cutting face from the sharp cutting tip of one of the two elongated side cutting edges to the sharp cutting tip of the other elongated side cutting edge, and extending parallel to the two narrow side cutting edges of the upper cutting face, the second upper cutting edge is adapted to first contact the material to be cut off from the workpiece and cut an inner area of a contour of the material to be cut off from the workpiece into two parts, each part still being connected to the workpiece and at least one of the narrow side cutting edges and at least one of the elongated side cutting edges of the first upper cutting edge are adapted to thereafter cut the two parts from the workpiece and separate the cut off material into two separate parts that each have a reduced linear dimension than the entire material cut off from the workpiece, in one punching stroke; and a distance (A) between the upper cutting face and the lower cutting face in a direction parallel to the punching direction, increases linearly along both of the portions of each of the two elongated side cutting edges of the first upper cutting edge from a smallest distance (A) at the sharp cutting tip to a larger distance (A) at the two narrow side cutting edges of the upper cutting face.

2. A method for cutting off material from a workpiece and for reducing a linear dimension of the material cut off from the workpiece, the method comprising obtaining a punching tool of claim 1 and mounting the punching tool into a punching machine;

inserting a workpiece into the punching machine; and performing a single punching stroke with the punching tool, whereby a part of the material to be cut off from the workpiece is cut off with the first upper cutting edge and a linear dimension of the cut off part is reduced by cutting the cut off part of the material with the at least one second upper cutting edge in the same punching stroke, wherein the material to be cut off is first cut by the at least one second upper cutting edge into at least two parts, each still being connected to the workpiece, and those two parts are then cut off from the workpiece by at least one of the narrow side cutting edges and at least one of the elongated side cutting edges of the first upper cutting edge in a continuous motion of the upper tool part in the same punching stroke.

3. The method of claim 2, wherein the punching tool comprises a transition region that further reduces the linear dimension of the cut off part of the material by deforming the cut off part of the material.

4. A punching tool for a punching machine for cutting off material from a plate-shaped workpiece and for reducing a linear dimension of the material cut off from the workpiece, the punching tool comprising an elongated upper tool part and an elongated lower tool part that when mounted in a punching machine are arranged to move relative to each other in a punching direction, wherein: the elongated upper tool part comprises a first upper cutting edge and the lower tool part comprises a lower cutting edge, wherein the first upper cutting edge comprises two narrow side cutting edges and two elongated side cutting edges of the elongated upper tool part to delimit an upper cutting face and the lower cutting edge comprises side edges of the elongated lower tool part to delimit a lower cutting face, wherein the first upper cutting edge and the lower cutting edge are arranged opposite to each other, respectively, so that a material is cut off from the workpiece by the respective first upper cutting edge and the lower cutting edge upon a punching stoke; the two elongated side cutting edges of the first upper cutting edge are each partitioned into two portions by a transition region comprising a discontinuity in the form of a sharp cutting tip, wherein the discontinuity of the sharp cutting tip comprises a triangular cross-section with sides having an angle that is steeper than an angle of the two portions of the elongated side cutting edges on either side of the discontinuity when viewed perpendicular to the elongated side cutting edges, and wherein a second upper cutting edge extends entirely across the upper cutting face from the sharp cutting tip of one of the two elongated side cutting edges to the sharp cutting tip of the other elongated side cutting edge, and extending parallel to the two narrow side cutting edges of the upper cutting face, the second upper cutting edge is adapted to first contact the material to be cut off from the workpiece and cut an inner area of a contour of the material to be cut off from the workpiece into two parts, each part still being connected to the workpiece, and at least one of the narrow side cutting edges and at least one of the elongated side cutting edges of the first upper cutting edge are adapted to thereafter cut the two parts from the workpiece and separate the cut off material into two separate parts that each have a reduced linear dimension than the entire material cut off from the workpiece, in one punching stroke; and a distance (A) between the upper cutting face and the lower cutting face in a direction parallel to the punching direction increases non-linearly along the two portions of each of the two elongated side cutting edges of the first upper cutting edge from a smallest distance (A) at the sharp cutting tip to larger distances (A) at the two narrow side cutting edges of the upper cutting face, wherein the two portions of each of the two elongated side cutting edges adjacent to the sharp cutting tip comprise a concave shape in the direction parallel to the punching direction.

5. A method for cutting off material from a workpiece and for reducing a linear dimension of the material cut off from the workpiece, the method comprising obtaining a punching tool of claim 4 and mounting the punching tool into a punching machine;

inserting a workpiece into the punching machine; and performing a single punching stroke with the punching tool, whereby a part of the material to be cut off from the workpiece is cut off with the first upper cutting edge and a linear dimension of the cut off part is reduced by cutting the cut off part of the material with the at least one second upper cutting edge in the same punching stroke, wherein the material to be cut off is first cut by the at least one second upper cutting edge into at least two parts, each still being connected to the workpiece, and those two parts are then cut off from the workpiece by at least one of the narrow side cutting edges and at least one of the elongated side cutting edges of the first upper cutting edge in a continuous motion of the upper tool part in the same punching stroke.

6. The method of claim 5, wherein the punching tool comprises a transition region that further reduces the linear dimension of the cut off part of the material by deforming the cut off part of the material.

7. A punching tool for a punching machine for cutting off material from a plate-shaped workpiece and for reducing a linear dimension of the material cut off from the workpiece, the punching tool comprising an elongated upper tool part and an elongated lower tool part that when mounted in a punching machine are arranged to move relative to each other in a punching direction, wherein: the elongated upper tool part comprises a first upper cutting edge and the lower tool part comprises a lower cutting edge, wherein the first upper cutting edge comprises two narrow side cutting edges and two elongated side cutting edges of the elongated upper tool part to delimit an upper cutting face and the lower cutting edge comprises side edges of the elongated lower tool part to delimit a lower cutting face, wherein the first upper cutting edge and the lower cutting edge are arranged opposite to each other, respectively, so that a material is cut off from the workpiece by the respective first upper cutting edge and the lower cutting edge upon a punching stoke; the two elongated side cutting edges of the first upper cutting edge are each partitioned into two portions by a transition region comprising a discontinuity in the form of a sharp cutting tip, wherein the discontinuity of the sharp cutting tip comprises a triangular cross-section with sides having an angle that is steeper than an angle of the two portions of the elongated side cutting edges on either side of the discontinuity when viewed perpendicular to the elongated side cutting edges, and wherein a second upper cutting edge extends entirely across the upper cutting face from the sharp cutting tip of one of the two elongated side cutting edges to the sharp cutting tip of the other elongated side cutting edge, and extending parallel to the two narrow side cutting edges of the upper cutting face, the second upper cutting edge is adapted to first contact the material to be cut off from the workpiece and cut an inner area of a contour of the material to be cut off from the workpiece into two parts, each part still being connected to the workpiece, and at least one of the narrow side cutting edges and at least one of the elongated side cutting edges of the first upper cutting edge are adapted to thereafter cut the two parts from the workpiece and separate the cut off material into two separate parts that each have a reduced linear dimension than the entire material cut off from the workpiece, in one punching stroke; and a distance (A) between the upper cutting face and the lower cutting face in a direction parallel to the punching direction increases non-linearly along the two portions of each of the two elongated side cutting edges of the first upper cutting edge from a smallest distance (A) at the sharp cutting tip to larger distances (A) at the two narrow side cutting edges of the upper cutting face, wherein the two portions of each of the two elongated side cutting edges adjacent to the sharp cutting tip comprise a convex shape in the direction parallel to the punching direction.

8. A method for cutting off material from a workpiece and for reducing a linear dimension of the material cut off from the workpiece, the method comprising obtaining a punching tool of claim 7 and mounting the punching tool into a punching machine;

inserting a workpiece into the punching machine; and performing a single punching stroke with the punching tool, whereby a part of the material to be cut off from the workpiece is cut off with the first upper cutting edge and a linear dimension of the cut off part is reduced by cutting the cut off part of the material with the at least one second upper cutting edge in the same punching stroke, wherein the material to be cut off is first cut by the at least one second upper cutting edge into at least two parts, each still being connected to the workpiece, and those two parts are then cut off from the workpiece by at least one of the narrow side cutting edges and at least one of the elongated side cutting edges of the first upper cutting edge in a continuous motion of the upper tool part in the same punching stroke.

9. The method of claim 8, wherein the punching tool comprises a transition region that further reduces the linear dimension of the cut off part of the material by deforming the cut off part of the material.

* * * * *